US010731461B2

(12) United States Patent
Perry

(10) Patent No.: US 10,731,461 B2
(45) Date of Patent: Aug. 4, 2020

(54) GUIDE SHOE FOR MINING MACHINE

(71) Applicant: Joy MM Delaware, Inc., Wilmington, DE (US)

(72) Inventor: Ryan E. Perry, Venus, PA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 719 days.

(21) Appl. No.: 15/374,747

(22) Filed: Dec. 9, 2016

(65) Prior Publication Data

US 2017/0167259 A1 Jun. 15, 2017

Related U.S. Application Data

(60) Provisional application No. 62/264,988, filed on Dec. 9, 2015.

(51) Int. Cl.
*E21C 29/02* (2006.01)
*E21C 35/12* (2006.01)

(52) U.S. Cl.
CPC ..... *E21C 29/02* (2013.01); *E21C 35/12* (2013.01)

(58) Field of Classification Search
CPC ..... E21C 29/02; E21C 29/22; E21C 35/12; E21C 35/08
See application file for complete search history.

(56) References Cited

U.S. PATENT DOCUMENTS 3,768,866 A 10/1973 Hauschopp et al.
3,856,358 A 12/1974 Krekeler
4,357,052 A 11/1982 Pilarski et al.
4,515,409 A 5/1985 Parrott
4,583,785 A 4/1986 Breuer et al.
5,131,723 A 7/1992 Roling
5,704,267 A * 1/1998 Merten ..... E21C 29/02 104/248

(Continued)

FOREIGN PATENT DOCUMENTS

CN 201747373 U 2/2011
CN 102116152 A 7/2011

(Continued)

OTHER PUBLICATIONS

Search Report from the Polish Patent Office for Application No. P-419732 dated Jun. 7, 2017 (3 pages).

(Continued)

*Primary Examiner* — Scott A Browne
(74) *Attorney, Agent, or Firm* — Michael Best & Friedrich LLP

(57) ABSTRACT

A guide shoe for a mining machine includes an elongated shoe body, a slot, an insert coupled to the shoe body, and a retainer secured to the shoe body. The shoe body includes a first end, a second end, a first wall, and a second wall. The slot extends between the first end and the second end along a slot axis, and the slot extends along the first wall and the second wall. The insert is positioned between the shoe body and the slot axis and extends along at least a portion of a perimeter of a cross-section of the slot. The insert includes an end positioned adjacent the first end of the shoe body. The retainer abuts the end of the insert to secure the insert against movement relative to the shoe body in a direction parallel to the slot axis.

22 Claims, 17 Drawing Sheets

(56) References Cited

U.S. PATENT DOCUMENTS

| | | | | |
|---|---|---|---|---|
| 7,097,256 | B2 | 8/2006 | Tillessen et al. | |
| 7,314,253 | B2 | 1/2008 | Tillessen et al. | |
| 7,431,401 | B2 | 10/2008 | Wesselmann et al. | |
| 7,731,298 | B2 * | 6/2010 | Merten | E21C 29/02 299/34.11 |
| 8,262,169 | B2 | 9/2012 | Hill | |
| 8,276,991 | B2 * | 10/2012 | Thomson | E21C 29/02 299/42 |
| 8,393,687 | B2 * | 3/2013 | Powell | E21C 29/02 299/42 |
| 8,789,892 | B2 | 7/2014 | Niederriter et al. | |
| 2005/0151412 | A1 | 7/2005 | Tillessen et al. | |
| 2005/0161995 | A1 * | 7/2005 | Tillessen | E21C 35/12 299/34.1 |
| 2007/0194618 | A1 | 8/2007 | Wesselmann et al. | |
| 2010/0019563 | A1 * | 1/2010 | Thomson | E21C 29/02 299/43 |
| 2012/0104832 | A1 | 5/2012 | Niederriter et al. | |

FOREIGN PATENT DOCUMENTS

| | | | |
|---|---|---|---|
| CN | 203296773 | U | 11/2013 |
| CN | 203347792 | U | 12/2013 |
| CN | 103967487 | U | 8/2014 |
| DE | 3711105 | A1 | 10/1988 |
| DE | 3817339 | A1 | 12/1988 |
| GB | 2017788 | A | 10/1979 |
| GB | 2432603 | A | 5/2007 |
| PL | 166850 | B1 | 6/1995 |

OTHER PUBLICATIONS

Wang et al., "Discussion and Research on Self-adapted Sliding Boots of Coal Mining Machine", Coal Mine Machinery, Issue No. 11, p. 187-188, Nov. 2014 (2 pages).

Chinese Patent Office Action for Application No. 201611121852.1 dated May 31, 2019.

Office Action issued by the Federal Institute of Industrial Property for Application No. 2016148186/03, dated May 28, 2020 (13 pages including English translation).

* cited by examiner

GUIDE SHOE FOR MINING MACHINE

CROSS-REFERENCE TO RELATED APPLICATION

This application claims the benefit of prior-filed, U.S. Provisional Patent Application No. 62/264,988, filed Dec. 9, 2015, the entire contents of which are incorporate herein by reference.

BACKGROUND

The present disclosure relates to the field of mining machines and particularly to a trapping shoe for a longwall shearer mining machine.

Conventional longwall shearers include a frame and a pair of cutting assemblies mounted on each end of the frame. Each cutting assembly includes a cutting drum for engaging a mine wall. As the frame traverses a mine frame, the cutting drums cut material from the mine face. In some embodiments, the material is deposited on a conveyor and carried away from the mine face. The shearer includes a trapping shoe and sprocket that engage a rack to guide the machine with respect to the mine wall. During operation, the trapping shoe wears down, resulting in poor engagement between the sprocket and the rack and reducing machine control.

SUMMARY

In one aspect, guide shoe for a mining machine includes an elongated shoe body, an insert coupled to the shoe body, and at least one fastener. The shoe body includes a first end, a second end, and a slot extending between the first end and the second end along a slot axis. The shoe body further includes a first wall extending along a first side of the slot and a second wall extending along a second side of the slot. The insert extends along at least a portion of a perimeter of a cross-section of the slot. The insert is positioned between the first wall and the slot axis and between the second wall and the slot axis. The insert includes an end positioned adjacent the first end of the shoe body. The at least one fastener secures the insert against movement relative to the body in a direction parallel to the slot axis. The fastener is oriented in a direction parallel to the slot axis.

In another aspect, a drive mechanism for a mining machine is configured to engage and move the mining machine along a rack. The drive mechanism includes a motor, a gear driven by the motor, and a guide shoe. The gear is configured to engage the rack such that rotation of the gear moves the mining machine along the rack. The guide shoe maintains engagement between the gear and the rack. The guide shoe includes an elongated shoe body, an insert coupled to the shoe body, and at least one fastener. The shoe body includes a first end, a second end, and a slot extending between the first end and the second end along a slot axis. The body further includes a first wall extending along a first side of the slot and a second wall extending along a second side of the slot. The insert extends along at least a portion of a perimeter of a cross-section of the slot. The insert is positioned between the first wall and the slot axis and between the second wall and the slot axis. The insert includes an end positioned adjacent the first end of the shoe body. The at least one fastener secures the insert against movement relative to the body in a direction parallel to the slot axis. The fastener is oriented in a direction parallel to the slot axis.

In yet another aspect, a guide shoe for a mining machine includes an elongated shoe body, a slot, an insert coupled to the shoe body, and a retainer secured to the shoe body. The shoe body includes a first end, a second end, a first wall, and a second wall. The slot extends between the first end and the second end along a slot axis, and the slot extends along the first wall and the second wall. The insert is positioned between the shoe body and the slot axis and extends along at least a portion of a perimeter of a cross-section of the slot. The insert includes an end positioned adjacent the first end of the shoe body. The retainer abuts the end of the insert to secure the insert against movement relative to the shoe body in a direction parallel to the slot axis.

Other aspects will become apparent by consideration of the detailed description and accompanying drawings.

DETAILED DESCRIPTION

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
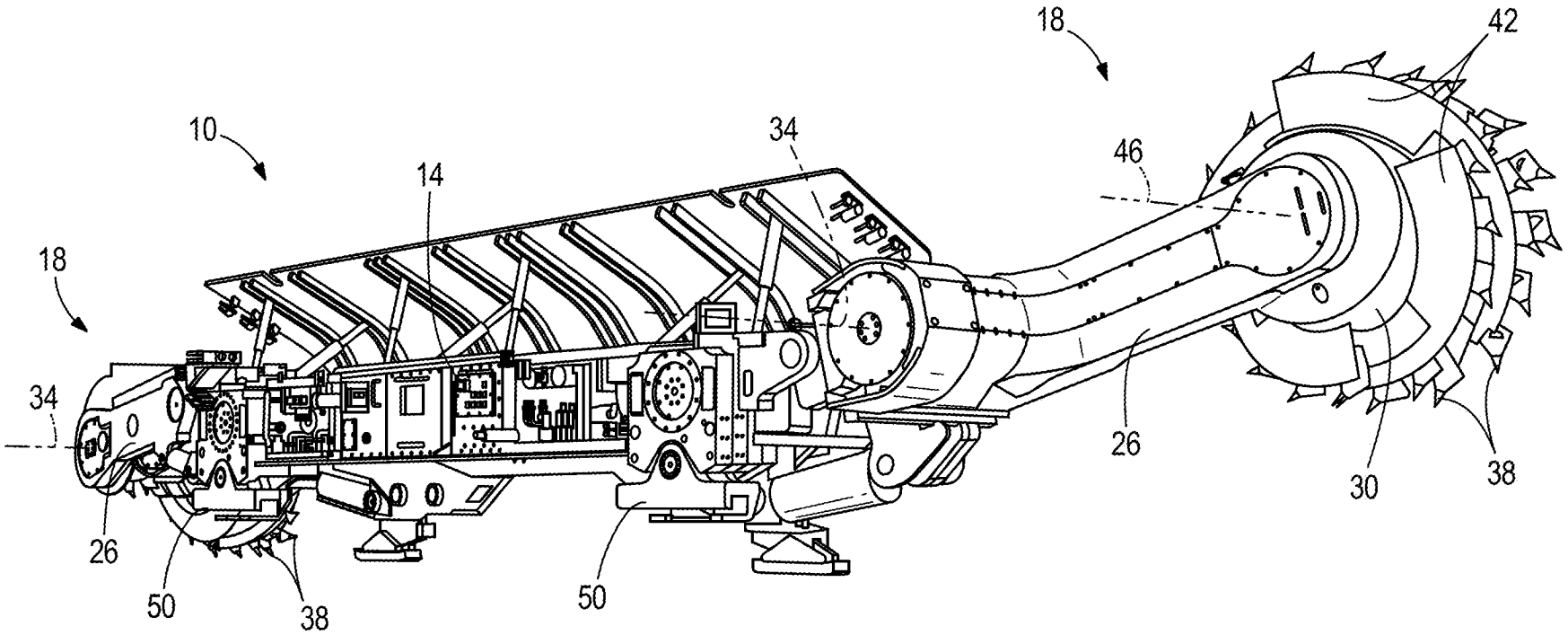
FIG. 1 is a perspective view of a mining machine.

FIG. 1 illustrates a mining machine, such as a longwall shearer 10. In the illustrated embodiment, the shearer 10 includes a chassis or frame 14 and a pair of cutting assemblies 18. Each cutting assembly 18 includes a ranging arm 26 and a cutting drum 30. Each ranging arm 26 is pivotably coupled to an end of the frame 14 and pivots about an arm axis 34. Each ranging arm 26 also rotatably supports the cutting drum 30. Each cutting drum 30 includes a generally cylindrical body and cutting bits 38. In the illustrated embodiment, vanes 42 extend in a helical manner along an outer surface or periphery of the drum 30, and the cutting bits 38 are positioned along the edges of the vanes 42. The drum 30 is coupled to the ranging arm 26 and is rotatable about a drum axis 46 that is substantially parallel to the arm axis 34.

Figure 2:
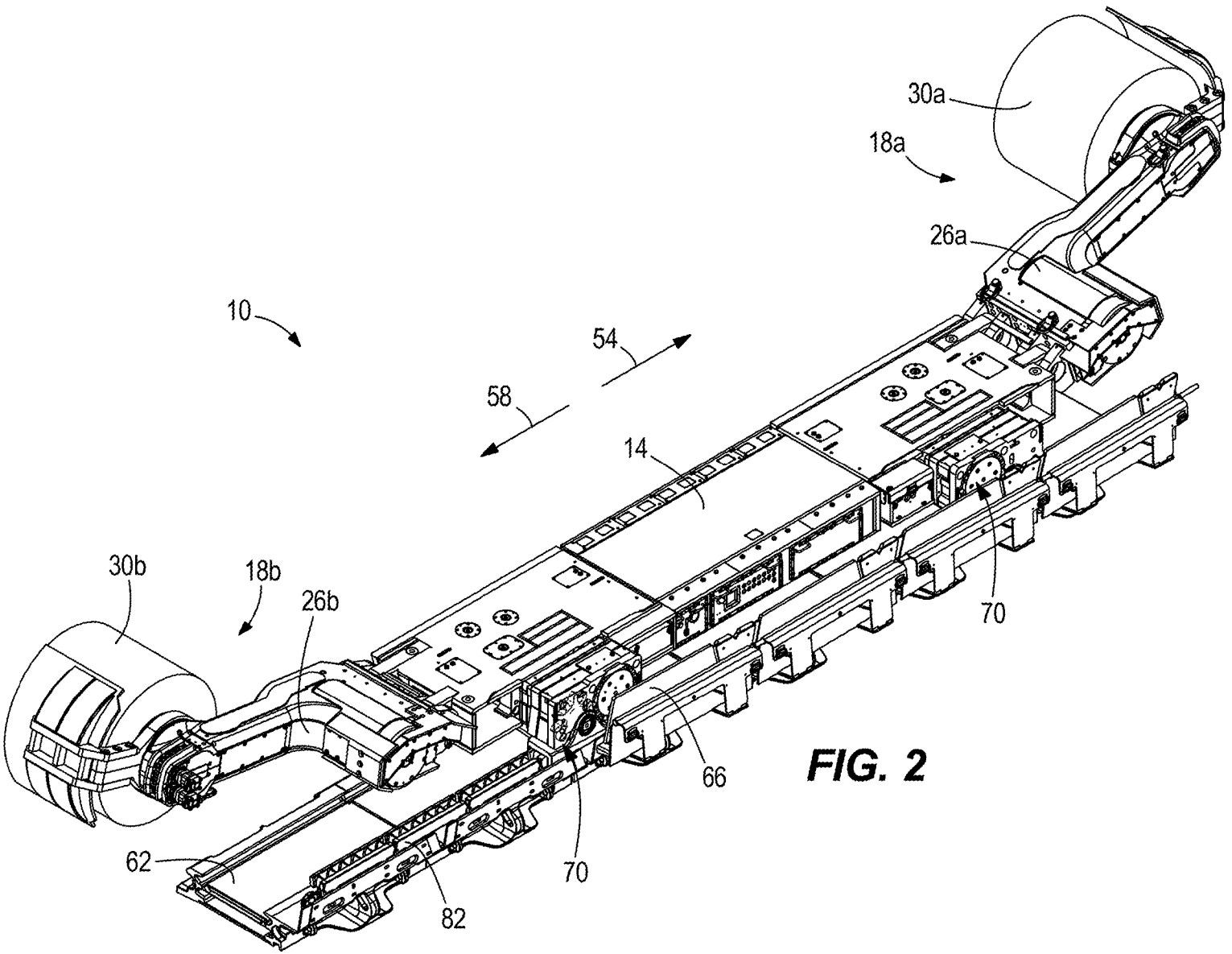
FIG. 2 is another perspective view of the mining machine of FIG. 1.
Figure 3:
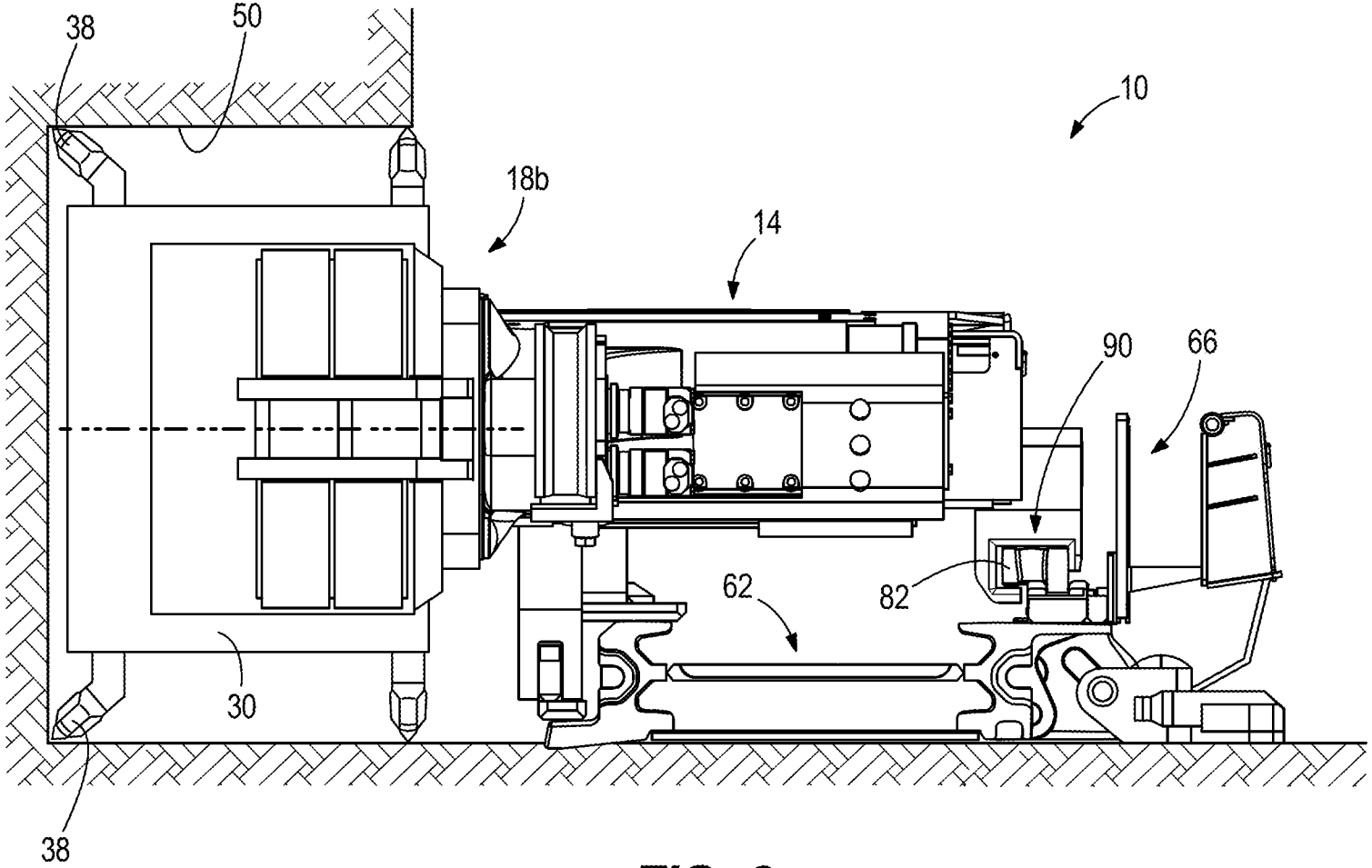
FIG. 3 is an end view of the mining machine of FIG. 1 engaging a mine wall.

As shown in FIGS. 2 and 3, the frame 14 is configured to tram or move along a mine face or wall 50 of material (FIG. 3) to be mined in a first direction 54 (FIG. 2) and a second direction 58 (FIG. 2). For simplicity, each drum 30 is illustrated as a cylinder. Each drum 30 engages the mine wall 50 such that the bits 38 (FIG. 1) cut material from the wall 50. As the cutting drum 30 rotates, the vanes 42 (FIG. 1) carry the cut material from the wall 50 toward a rear end of the drum 30, where the cut material is deposited onto a face conveyor 62. The face conveyor 62 carries the material toward a gate conveyor to be transported out of the mine. In the illustrated embodiment, a spill plate 66 and is positioned behind the frame 14 (i.e., away from the wall 50) to prevent cut material from falling behind the conveyor 62. In addition, a roof support (not shown) may be positioned behind the conveyor 62 and the spill plate 66.

As shown in FIG. 2, as the frame 14 moves in the first direction 54, a first cutting assembly 18*a* including a first ranging arm 26*a* and a first cutting drum 30*a* is in a leading position and a second cutting assembly 18*b* including a second ranging arm 26*b* and a second cutting drum 30*b* is in a trailing position. In one embodiment, the leading position is an elevated position in order to cut material, such as coal, from an upper portion of the mine wall 50, while the trailing position is a lower position to cut material from a lower portion of the mine wall 50.

Figure 4:
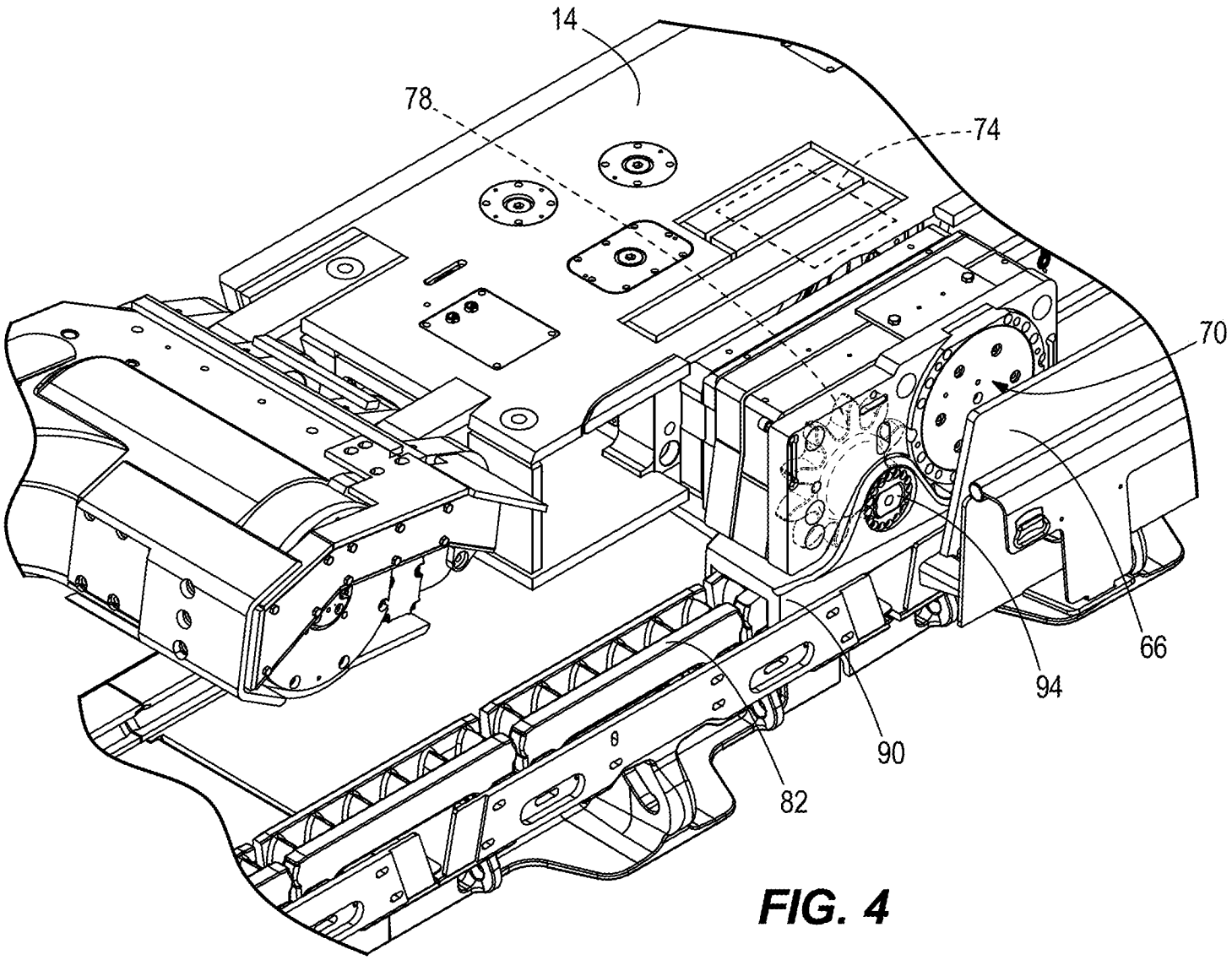
FIG. 4 is an enlarged perspective view of a portion of the mining machine of FIG. 1.
Figure 5:
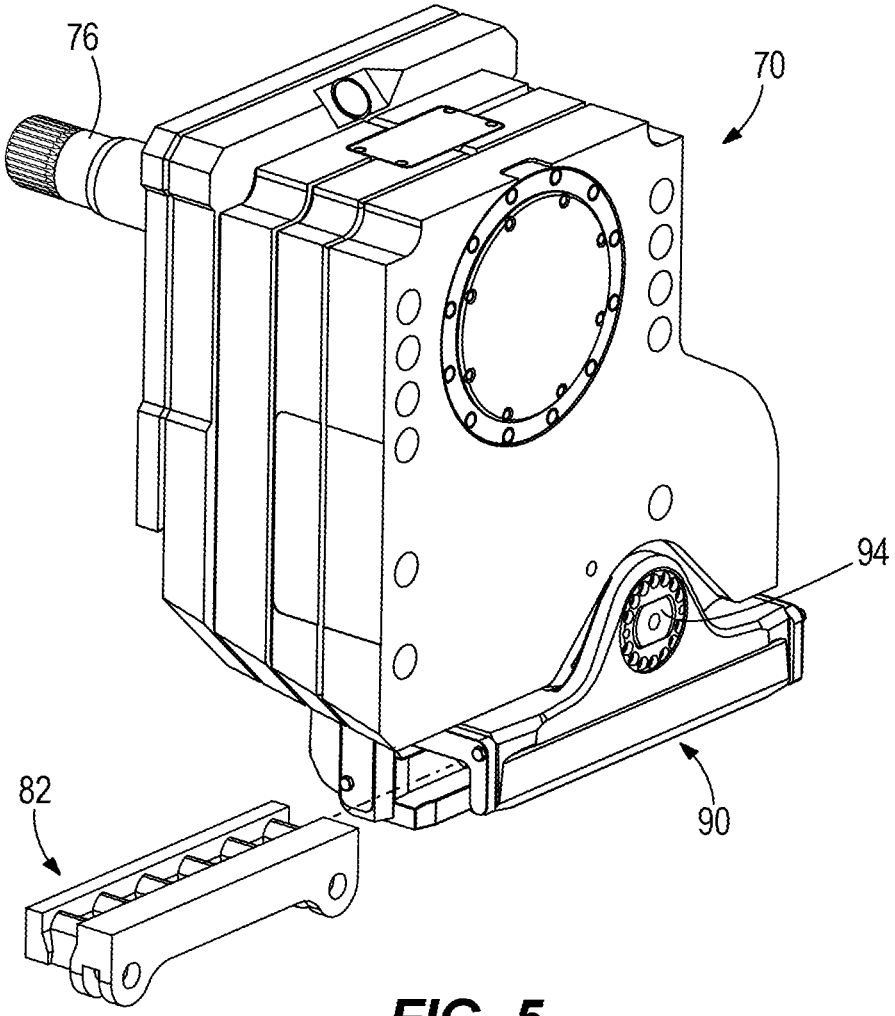
FIG. 5 is a perspective view of a drive mechanism.
Figure 6:
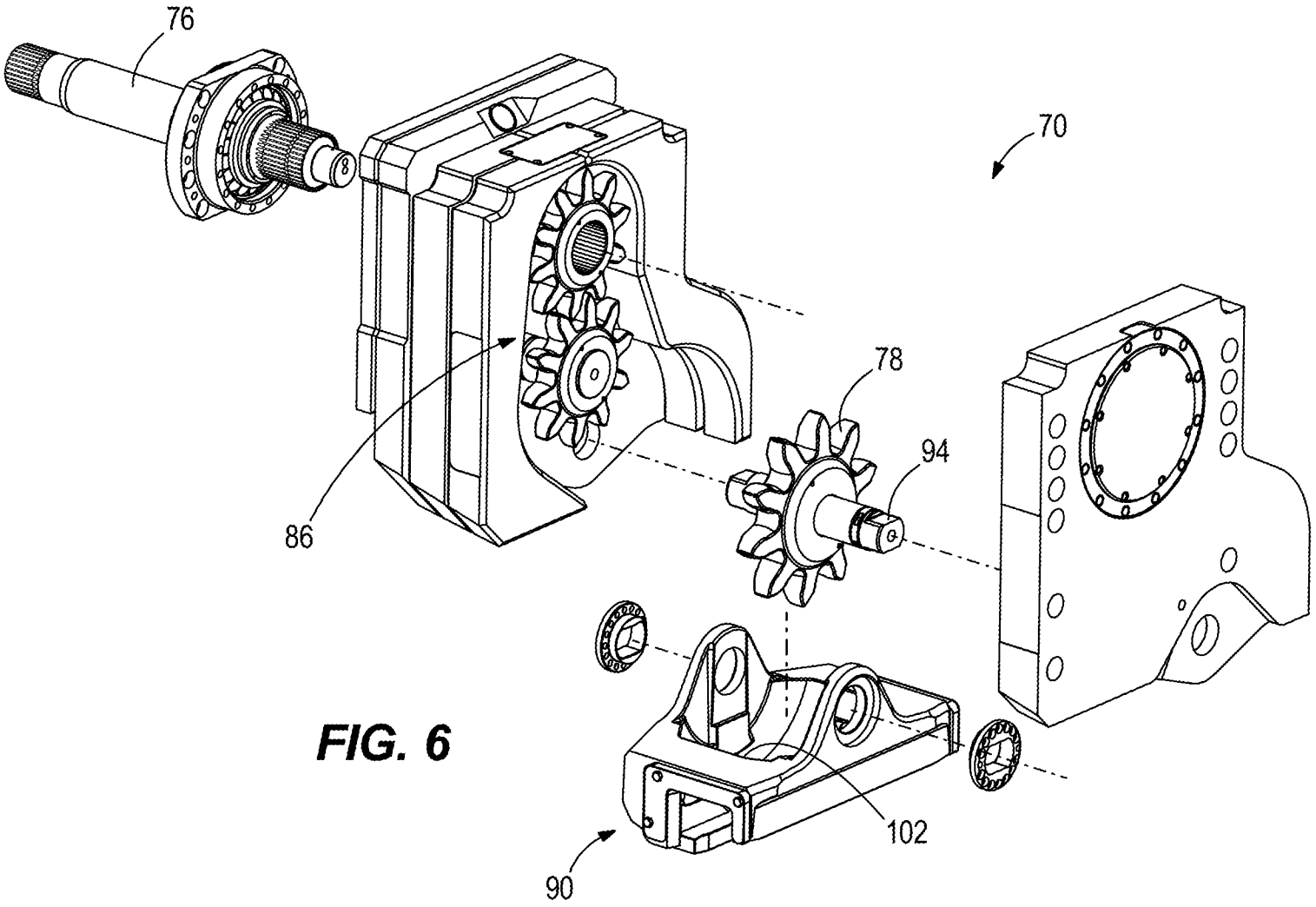
FIG. 6 is an exploded view of the drive mechanism of FIG. 5.

Referring now to FIG. 4, the frame 14 includes a drive mechanism 70 for moving the frame 14. FIGS. 5 and 6 illustrate a drive mechanism 70 according to some embodiments. The drive mechanism 70 includes a motor 74 (FIG. 4) driving an output shaft 76, which is turn drives a gear or sprocket 78 (FIG. 6). In the illustrated embodiment, a rack 82 is coupled to the face conveyor 62 (FIG. 2) and extends along the wall 50. The sprocket 78 (FIG. 4) engages the rack 82 to form a rack-and-pinion connection, such that rotation of the sprocket 78 causes translational movement of the frame 14 along the rack 82. In the illustrated embodiment, the output shaft 76 drives a gear train 86 (FIG. 6) that rotates the sprocket 78.

As shown in FIG. 5, a trapping shoe or guide shoe 90 is pivotably coupled to the frame 14 by a pin 94. The guide shoe 90 is slidably coupled to the rack 82. The sprocket 78 may be supported for rotation about the pin 94, and the teeth of the sprocket 78 extend through an opening 102 (FIG. 6) of the shoe 90 to engage the rack 82. Among other things, the guide shoe 90 guides the movement of the frame 14 relative to the rack 82 along the mine face and maintains alignment and engagement between the sprocket 78 and the rack 82. In the illustrated embodiment, a guide shoe 90 is positioned proximate each end of the frame 14; in other embodiments, the mining machine 10 may include fewer or more guide shoes.

Figure 7:
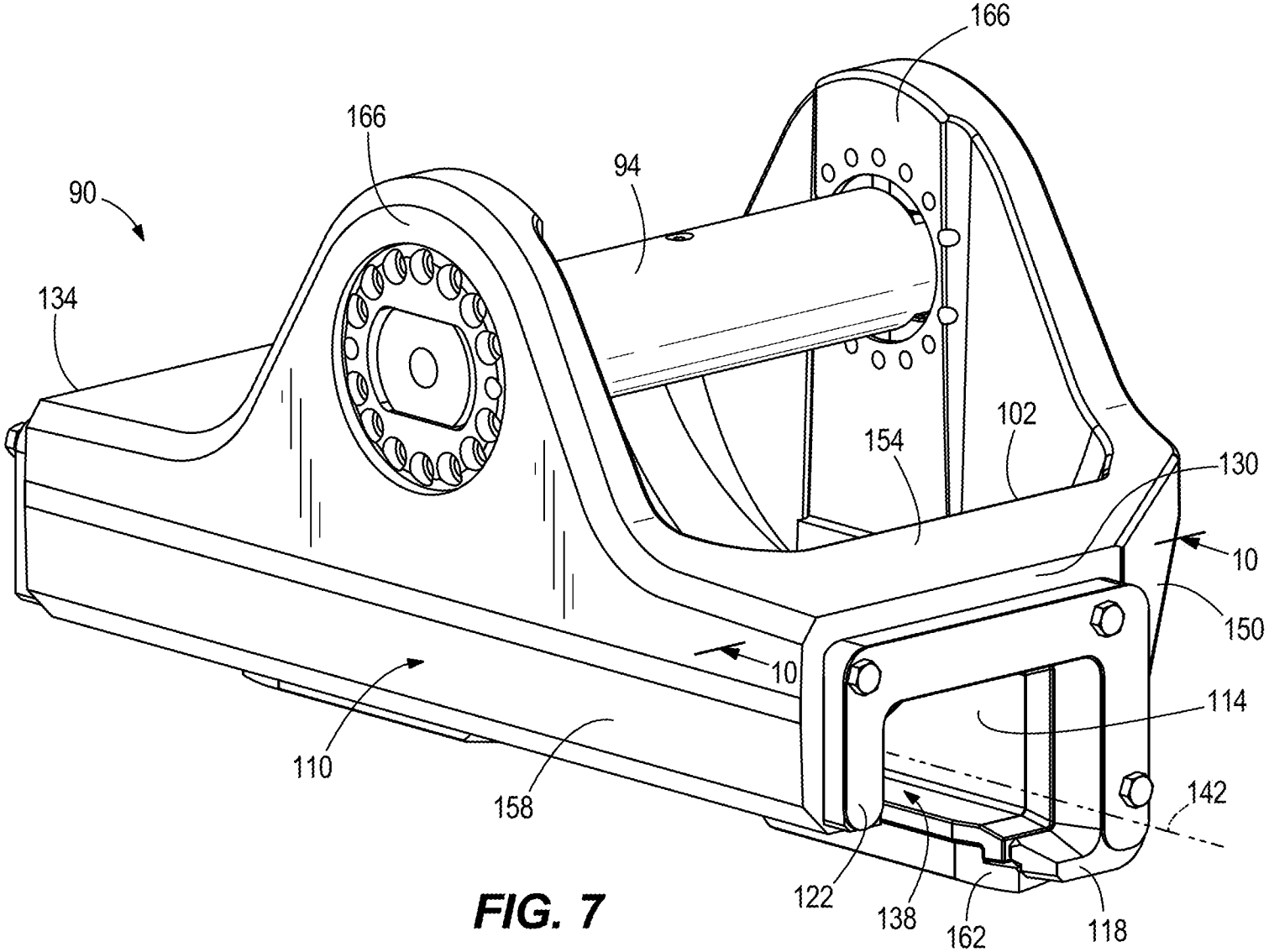
FIG. 7 is a perspective view of a guide shoe.

Referring to FIGS. 7-10, the guide shoe 90 includes a shoe body 110, a wear sleeve or insert 114, and a retainer 118. In the illustrated embodiment, the guide shoe 90 further includes a cover plate 122 (FIG. 7) secured to the retainer 118. The shoe body 110 includes a first end 130 and a second end 134 (FIG. 7). In addition, a slot 138 extends longitudinally between the first end 130 and the second end 134 along a slot axis 142. As used herein, the term "axial" and variants thereof refers to a direction that is parallel to the slot axis 142, and the term "radial" and variants thereof refers to a direction that is perpendicular to the slot axis 142. The slot 138 is sized to receive the rack 82 (FIG. 3). In the illustrated embodiment, a cross-section of the slot 138 transverse to the slot axis 142 forms an incomplete rectangle. In the illustrated embodiment, the pin 94 is positioned between the first end 130 and the second end 134.

Figure 10:
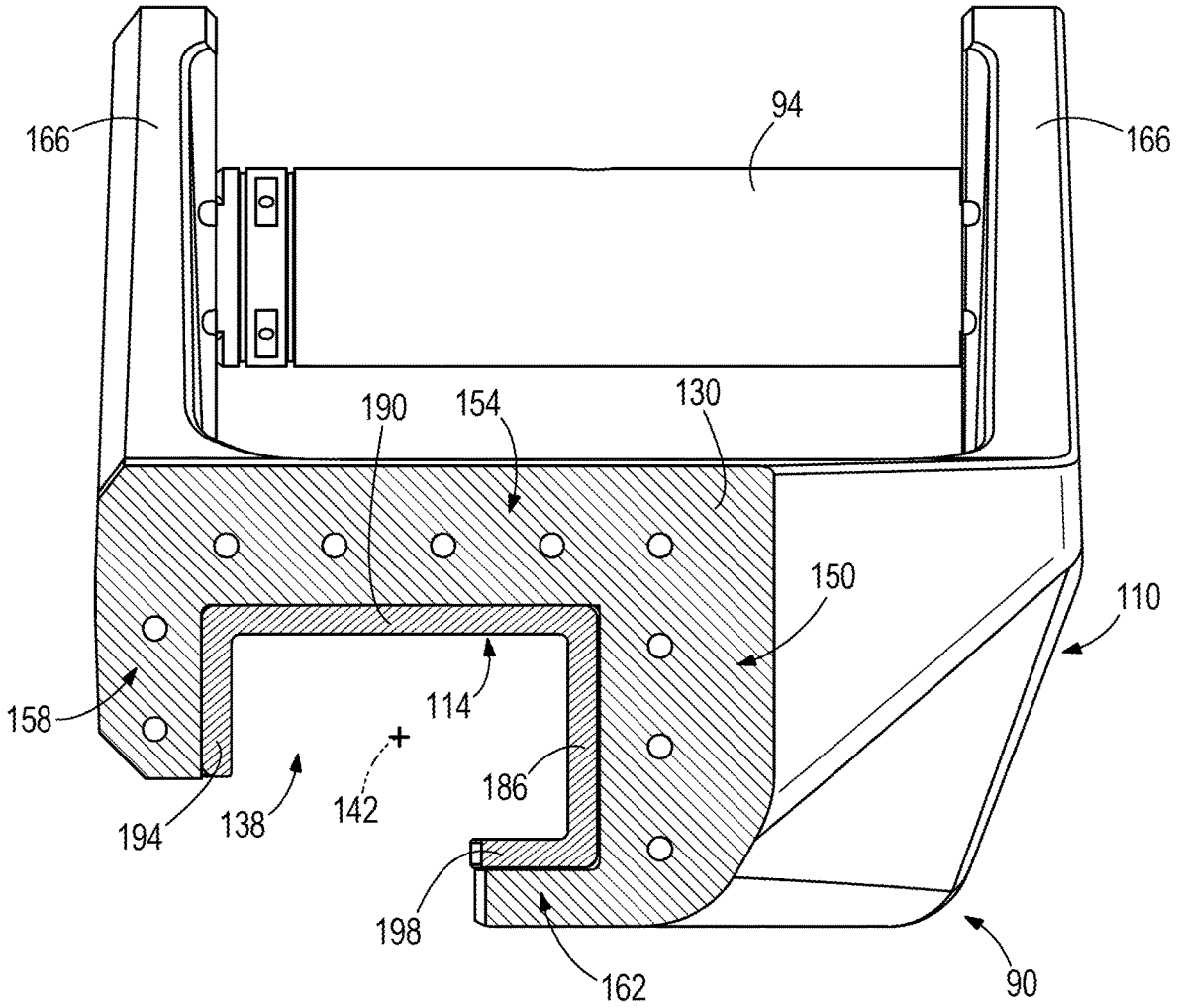
FIG. 10 is a section view of the guide shoe of FIG. 7 viewed along section 10-10.

As shown in FIG. 10, the shoe body 110 includes a first wall or base wall 150, a second wall or upper wall 154, a third wall or lateral guide wall 158, and a fourth wall or hook 162. In the illustrated embodiment, the base wall 150 and the upper wall 154 are connected together and oriented perpendicular to one another. Lugs 166 extend from an upper surface of the upper wall 154, and the pin 94 extends between the lugs 166. The lateral guide wall 158 protrudes from an edge of the upper wall 154 in a direction parallel to the base wall 150. The lateral guide wall 158 is spaced apart from the base wall 150 and extends parallel to the slot axis 142. The hook 162 protrudes from an edge of the base wall 150 in a direction parallel to the upper wall 154. The hook 162 is spaced apart from the upper wall 154 and extends along a portion of the slot axis 142.

The slot 138 is generally formed between the base wall 150, the upper wall 154, the lateral guide wall 158, and the hook 162. During operation, the hook 162 is positioned adjacent a lower surface of the rack 82 (FIG. 3), and the lateral guide wall 158 is positioned adjacent a side surface of the rack 82 (e.g., a rearward facing surface of the rack 82). The hook 162 maintains positive engagement between the sprocket 78 and the rack 82 while the shoe 90 slides relative to the rack 82.

Figure 8:
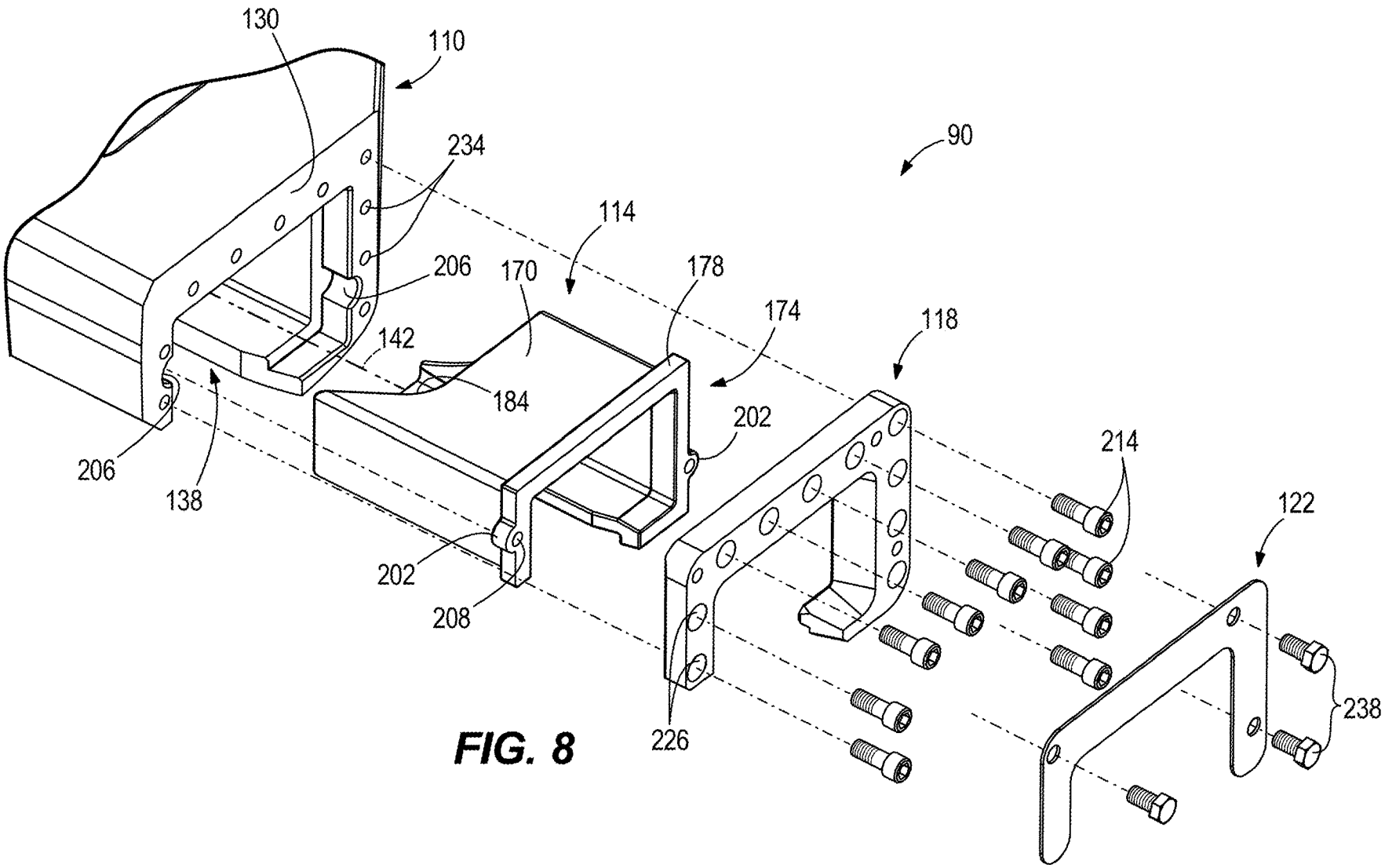
FIG. 8 is an exploded view of a guide shoe, an insert, a retainer, and a cover.
Figure 9:
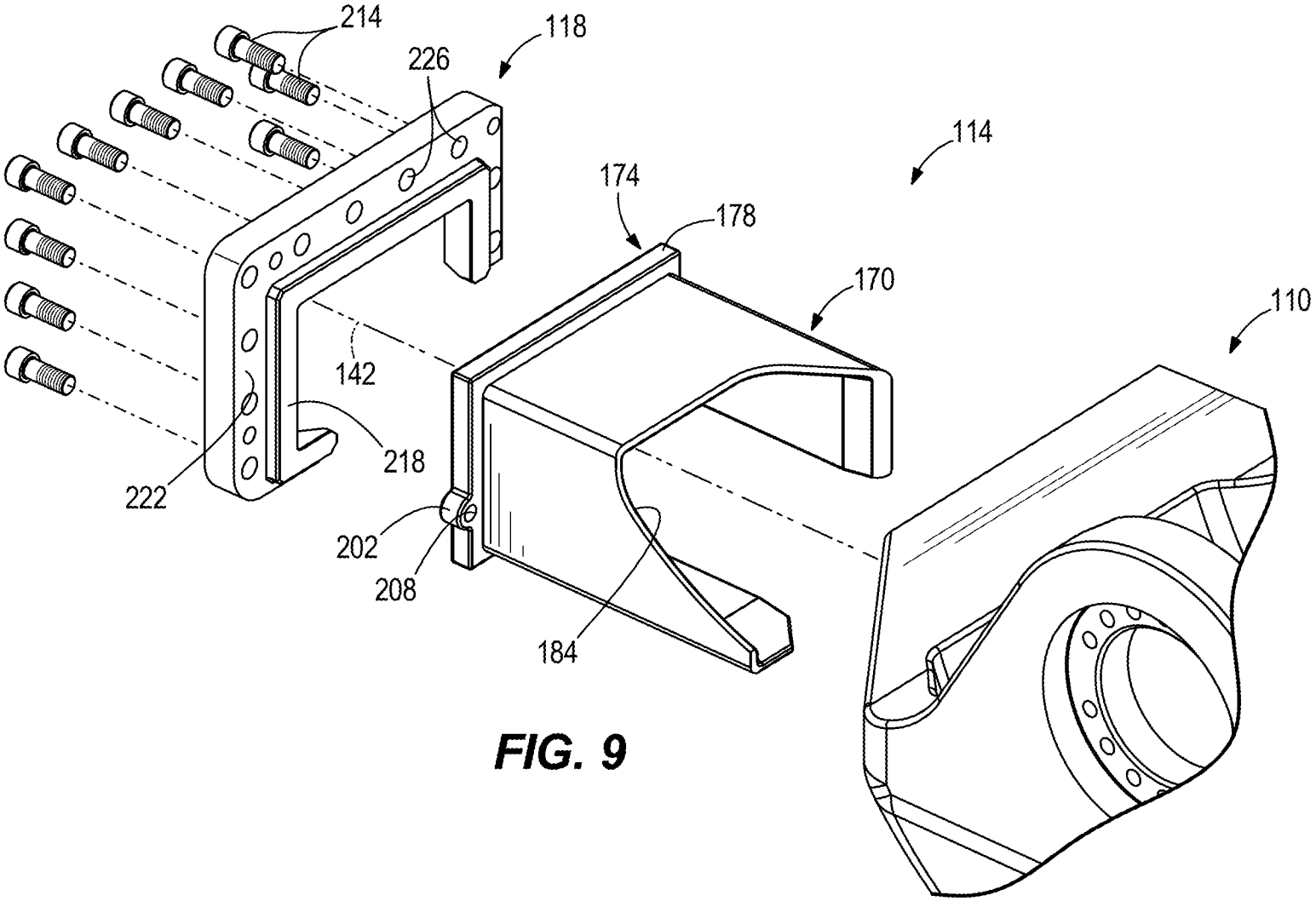
FIG. 9 is another exploded view of the guide shoe, the insert, and the retainer of FIG. 8.

As shown in FIGS. 8 and 9, the insert 114 is positioned within the slot 138. The insert 114 is axially received within the slot 138 from the first end 130 of the shoe body 110. The insert 114 includes an insert body 170 having an end 174 positioned adjacent the first end 130 of the shoe body 110. In the illustrated embodiment, the end 174 of the insert 114 is formed as a flange 178. The flange 178 is positioned within a shoulder or countersink 182 adjacent the first end 130 of the shoe body 110 and may prevent the insert 114 from being inserted too far into the slot 138. The flange 178 also facilitates a tight fit between the insert 114 and the shoe body 110 to minimize movement of the insert 114. In the illustrated embodiment, a portion of the insert 114 opposite the flange 178 includes a cutout 184 that follows the contour of the opening 102 (FIG. 7) in the shoe body 110, so that the insert 114 does not interfere with the engagement between the sprocket 78 (FIG. 4) and the rack 82.

As shown in FIG. 10, the insert 114 extends along a perimeter of the cross-section of the slot 138. The insert 114 is generally positioned between the slot axis 142 and the inner surfaces of the shoe body 110. Stated another way, a cross-section of the insert 114 transverse to the slot axis 142 has a shape that is generally similar to the cross-section of the slot 138. In particular, the insert 114 includes a base portion 186, an upper portion 190, a lateral portion 194, and a hook portion 198. The base portion 186 is positioned adjacent the base wall 150, the upper portion 190 is positioned adjacent the upper wall 154, the lateral portion 194 is positioned adjacent the lateral guide wall 158, and the hook portion 198 is positioned adjacent the hook 162 of the shoe body 110.

Figure 11:
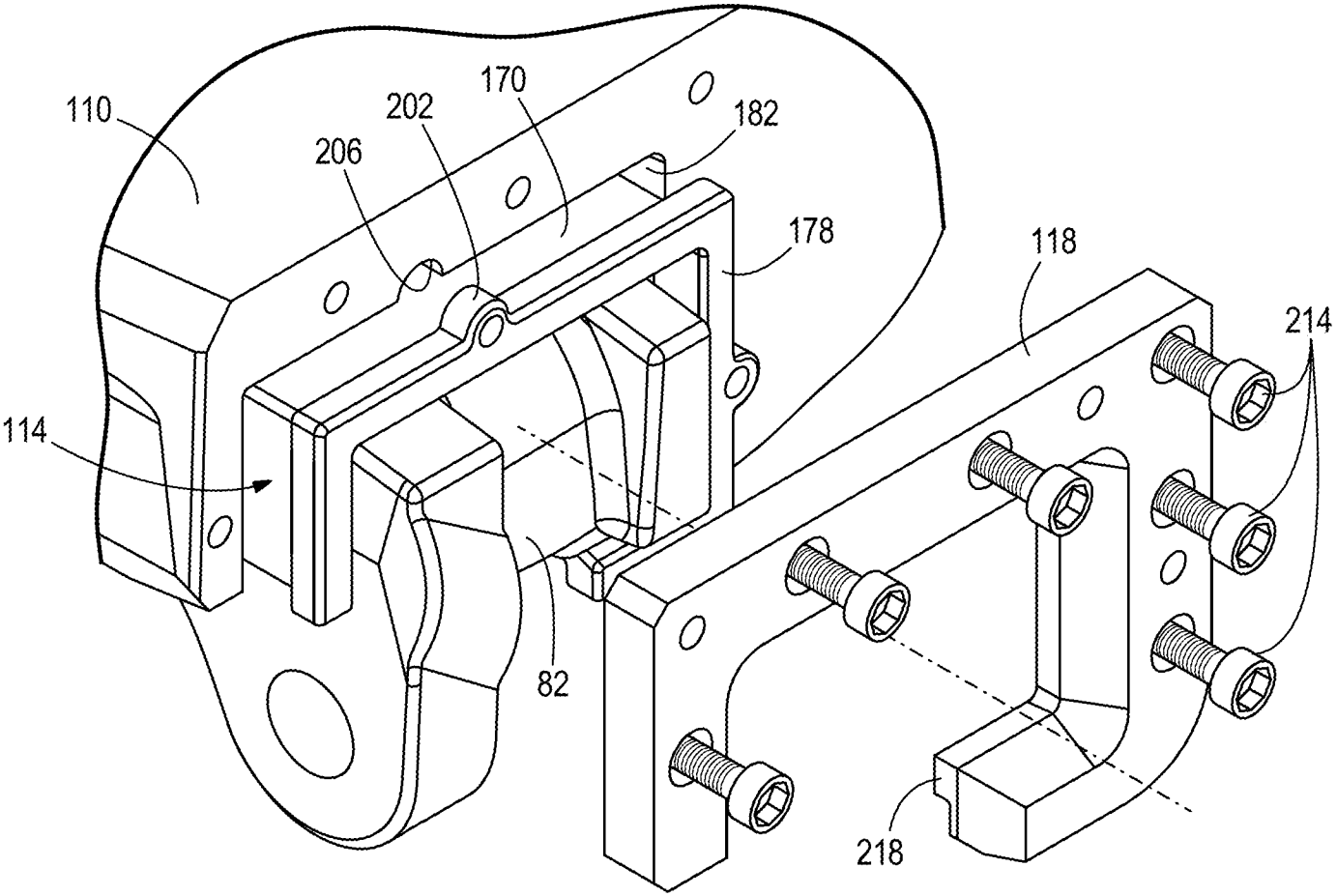
FIG. 11 is a partial exploded view of a guide shoe including an insert according to another embodiment.

Referring again to FIGS. 8 and 9, in the illustrated embodiment, the end 174 of the insert 114 includes tabs 202 extending laterally or radially away from the slot axis 142, and the tabs 202 are received within recesses 206 (FIG. 8) in the first end 130 of the shoe body 110 and assist in aligning the insert 114 within the slot 138. In the illustrated embodiment, the tabs 202 protrude from the base portion 186 and the lateral portion 194 of the insert 114; in other embodiments (FIG. 11), one or more tabs may protrude from the upper portion 190 instead of or in addition to one or more tabs protruding from the base portion 186 and/or lateral portion 194. In addition, in in the illustrated embodiment, the tabs 202 include pusher holes 208 to assist in removing the insert 114 from the slot 138.

As shown in FIGS. 8 and 9, the retainer 118 is positioned adjacent the first end 130 of the shoe body 110 and is secured to the shoe body 110, for example, by first fasteners 214. The retainer 118 extends along the perimeter of the insert 114 and the slot 138 and maintains the insert 114 within the slot 138. The retainer 118 includes a pilot or ridge 218 (FIG. 9) protruding from an inner surface 222 facing toward the insert 114 and extending around an inner perimeter of the retainer 118. The ridge 218 abuts the end 174 of the insert 114 and provides a reaction surface against loads exerted along the slot axis 142 rather than creating stress on the first fasteners 214.

The first fasteners 214 extend through apertures 226 of the retainer 118 and are secured to the first end 130 of the shoe body 110. The first fasteners 214 are oriented parallel to the slot axis 142. That is, the longitudinal axis of each fastener 214 is oriented in the same direction as the slot axis 142 and the same direction in which the insert 114 is inserted into the slot 138. In the illustrated embodiment, the first fasteners 214 are threaded bolts threaded into holes 234 (FIG. 8) in the first end 130 of the shoe body 110; in other embodiments, another type of fastener may be used. The cover 122 (FIG. 7) is secured to the retainer 118, for example, by second fasteners 238. The cover 122 may prevent dirt and fluid from entering the apertures 226 and corroding the first fasteners 214, and may also prevent the first fasteners 214 from completely unthreading from the shoe body 110.

Although the drawings illustrate an insert 114, retainer 118, and cover 122 coupled to the first end 130 of the shoe body 110, it is understood that the guide shoe 90 may include a substantially similar insert, retainer, and cover secured to the second end 134 of the shoe body 110.

By providing a separate retainer 118 to absorb the loads exerted along the slot axis 142 and retain the insert 114, the weight and complexity of the insert 114 (i.e., the replaceable wear component) may be reduced, thereby simplifying the machining/manufacturing process for forming the insert 114. The insert 114 may be manufactured using fewer machining processes, and may be manufactured from a lighter and/or less expensive material. The retainer 118 permits a looser fit between the insert 114 and the shoe body 110, permitting the insert 114 to "float" or move slightly relative to the shoe body 110. The insert 114 is less constrained and is subject to less stress, particularly at the corners.

The insert 114 is a wear element that absorbs wear caused by the sliding and rubbing contact between the shoe 90 and the rack 82, instead of wearing the inner surfaces of the shoe body 110. In some embodiments, the insert 114 may be formed from 8620 steel and hardened by carburization. In other embodiments, another material may be used and/or a different hardening process may be used. In some embodiments, the retainer 118 is formed from steel plate such as A572 or A514.

To replace the insert 114, the frame 14 may be lifted to remove the weight of the machine 10 from the guide shoe 90 and the insert 114. The first fasteners 214 are removed and the retainer 118 is removed. The insert 114 is removed from the slot 138 along the slot axis 142. A replacement insert 114 is then inserted into the slot 138 along the slot axis 142. In the illustrated embodiment, the insert 114 is inserted until the flange 178 engages the countersink 182 and the tabs 202 are positioned within the recesses 206. The retainer 118 and first fasteners 214 are then re-attached to secure the insert 114 to the shoe body 110. If additional room is required to replace the insert 114, the rack 82 can be lifted with the frame 14. The rack 82 can remain in the slot 138 while the insert 114 is replaced.

In a conventional mining machine, it is difficult for an operator to access a guide shoe from the front or the rear of the machine. However, the first fasteners 214 of the guide shoe 90 are accessible from the first end 130 of the shoe 90 and from the end of the machine 10. The retainer 118 and insert 114 can both be removed from the end of the shoe 90 along the axis 142 of the slot 138. That is, the insert 114 can slide to an outboard side of the machine 10 and can be serviced/replaced from the side of the machine 10. The insert 114 is more accessible for service purposes, thereby facilitating removal and replacement of the insert 114. Furthermore, repairing a worn insert 114 only requires lifting the frame 14 enough to remove the weight on the guide shoe 90; the sprocket 78, pin 94, and shoe 90 do not need to be disassembled in order to replace the insert 114. This simpler maintenance process reduces downtime of the machine 10 and the cost of maintenance, and reduces the need for operators to handle the heavy guide shoe 90 and lift replacement shoes over the spill plate 66.

The inserts 114 reduce wear on the shoe body 110 and can be changed more frequently than the shoe body 110. The insert 114 therefore extends the working life of the shoe body 110 and reduces the frequency with which the more expensive shoe body 110 must be replaced. Furthermore, the reduced wear will enable the guide shoe 90 to maintain proper meshing engagement between the sprocket 78 and the rack 82, thereby improving machine 10 control and reducing wear on the sprocket 78.

Also, since the insert 114 is a primary wear component, the guide shoe 90 may be formed from alternative and/or less expensive materials. Conventional guide shoes are formed from hardened high carbon steel to accommodate high wear; however, the shoe 90 may be formed from a less expensive material due to reduced wear on the shoe 90.

FIGS. 12-15 illustrate a guide shoe 490 according to another embodiment. For the sake of brevity, only differences between the guide shoe 490 and the guide shoe 90 are described. Similar features are labeled with similar reference numbers, plus 400.

Figure 12:
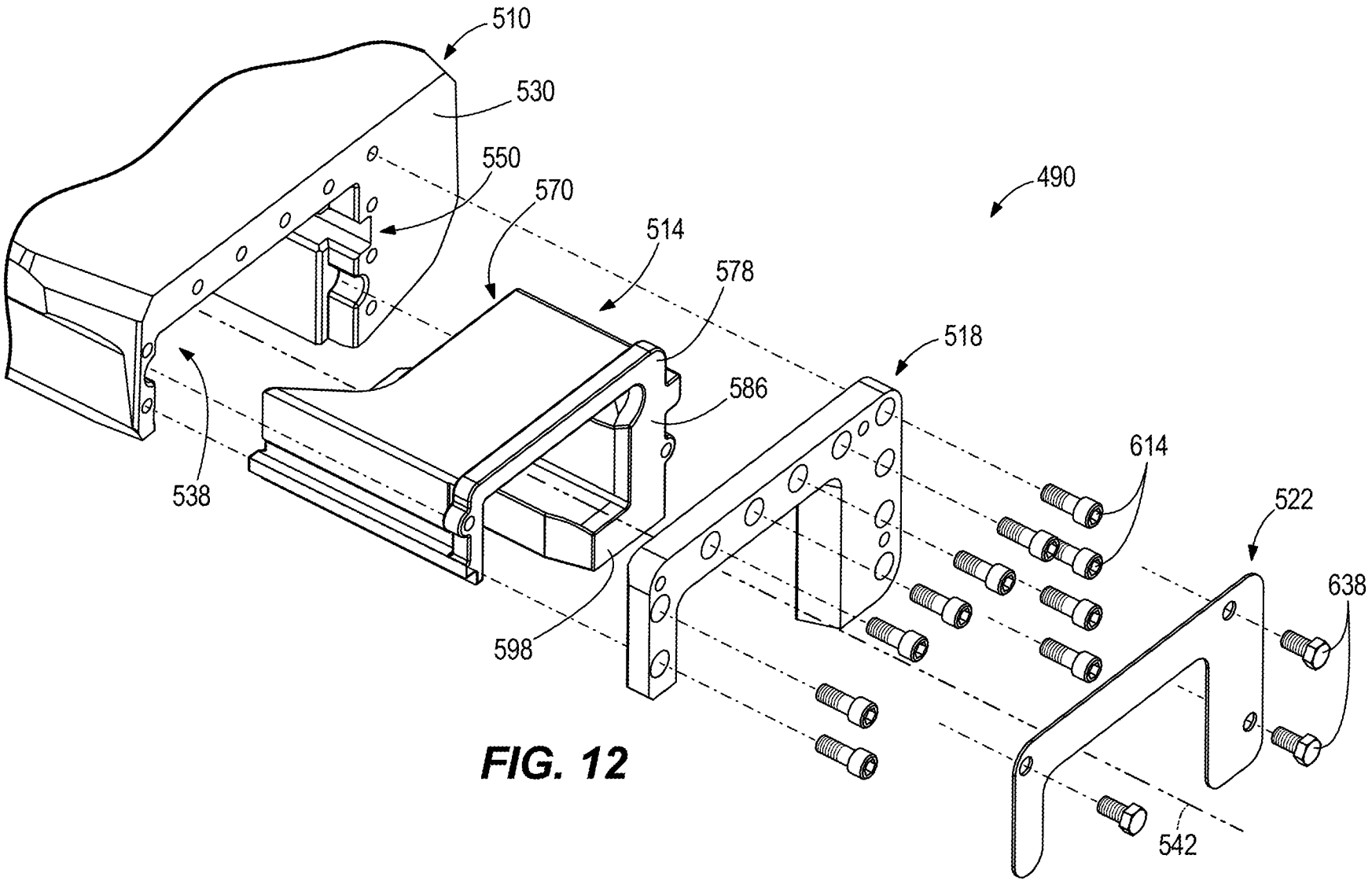
FIG. 12 is an exploded view of a guide shoe, an insert, and retainer according to another embodiment.
Figure 13:
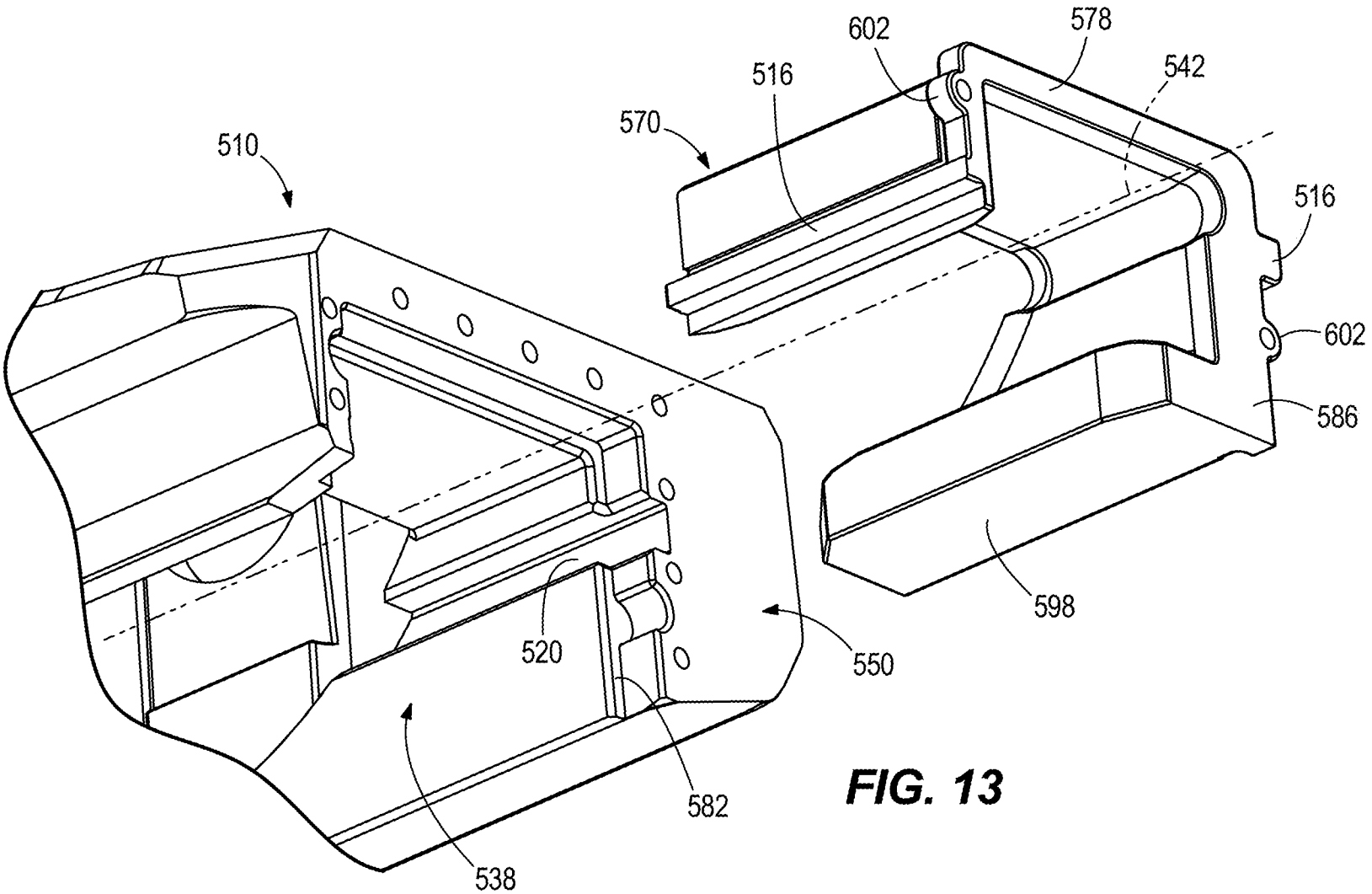
FIG. 13 is an exploded view of the guide shoe and the insert of FIG. 12.

Referring to FIGS. 12 and 13, the shoe body 510 does not include a hook as described above with respect to FIGS. 6-10. As a result, the transverse cross-section of the slot 538 in the shoe body 510 has an inverted U-shape. The insert 514 includes an insert body 570 and a flange 578, and further includes a hook portion 598 for engaging an underside of the rack 82 (FIG. 4). Since the shoe body 510 does not include a hook, the insert 514 directly reacts to vertical loads exerted on the hook portion 598 tending to lift the guide shoe 490 away from the rack 82. This reduces wear on the shoe body 510 and transfers the wear to the insert 514, which can be replaced more quickly and less expensively than the shoe body 510. A base portion 586 and the hook portion 598 of the insert 514 may be formed thicker than comparable portions of the insert 114.

Figure 14:
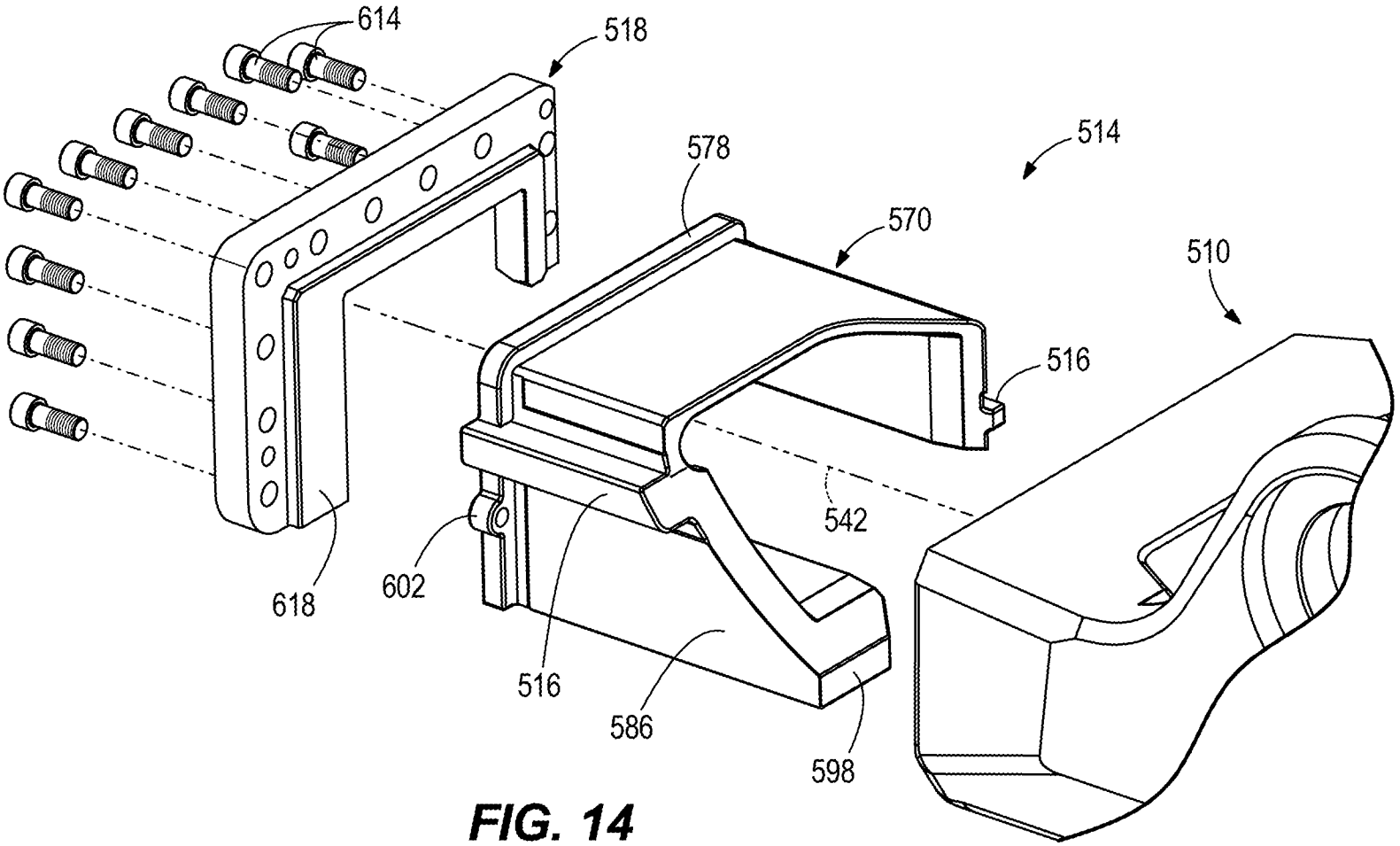
FIG. 14 is another exploded view of the guide shoe, the insert, and the retainer of FIG. 12.
Figure 15:
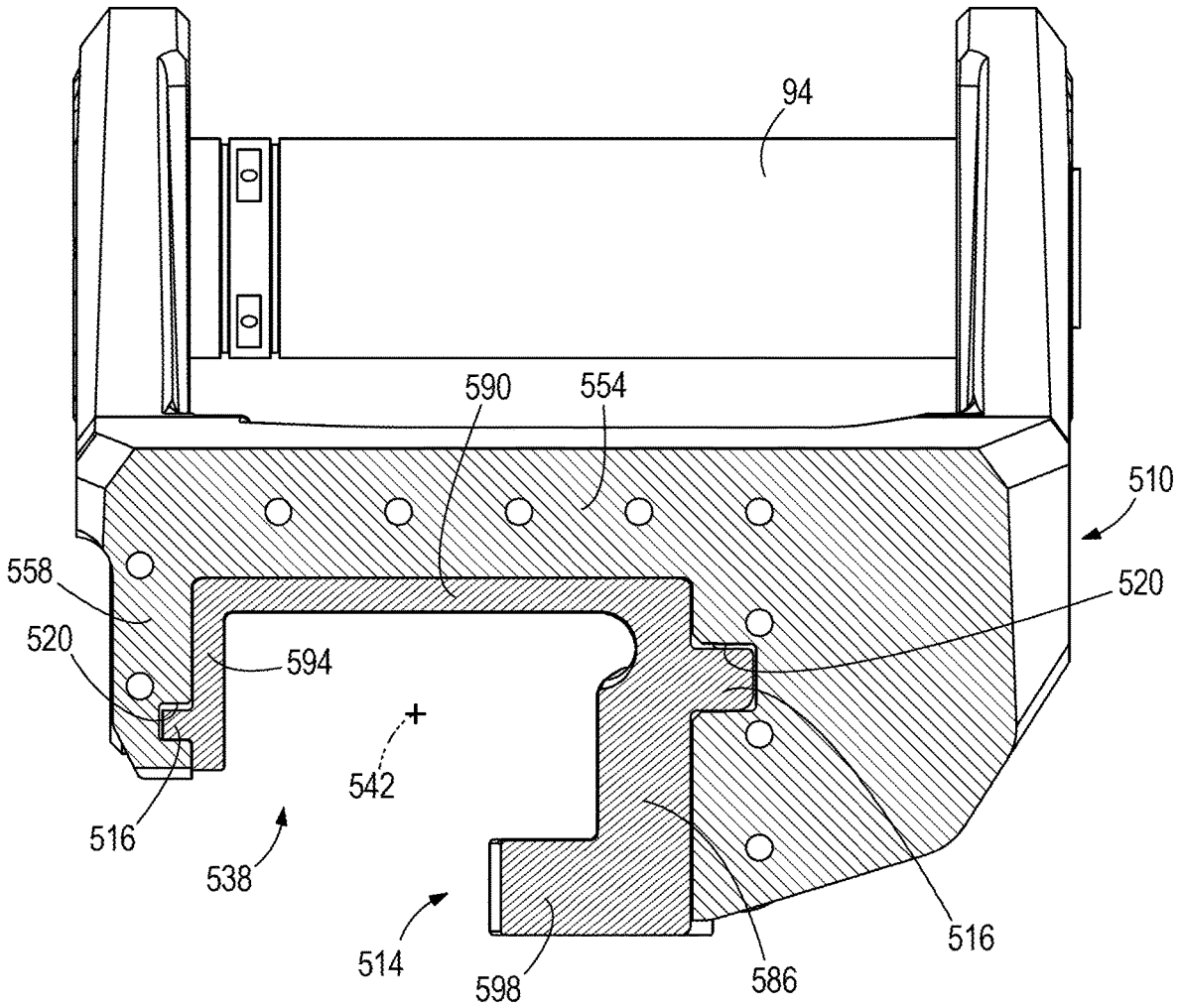
FIG. 15 is a section view of the guide shoe of FIG. 12 with the insert positioned in a slot.

As shown in FIGS. 13-15, the insert 514 includes longitudinal projections 516 protruding radially from the outer surfaces of the insert 514 and extending parallel to the slot axis 542. The projections 516 are positioned within grooves 520 (FIGS. 13 and 15) formed on the inner surfaces of the shoe body 510. The projections 516 and grooves 520 align the insert 514 relative to the slot 538, while also providing a reaction surface against torsional loads exerted about the slot axis 542. In the illustrated embodiment, the projections 516 protrude radially from the base portion 586 and a lateral portion 594 of the insert 514, respectively. In other embodiments, one or more projections 516 may protrude from an upper portion 590.

Also, as best shown in FIG. 12, a base wall 550 of the shoe body 510 may be formed with a larger thickness than the base wall 150 of the shoe body 110. Consequently, the portion of the retainer 518 secured to the base wall 550 may also have a larger thickness than a comparable portion of retainer 118. In the illustrated embodiment, the portion of the retainer 518 adjacent the base wall 550 and abutting the base portion 586 of the insert 514 does not include a laterally extending hook portion.

Figure 16:
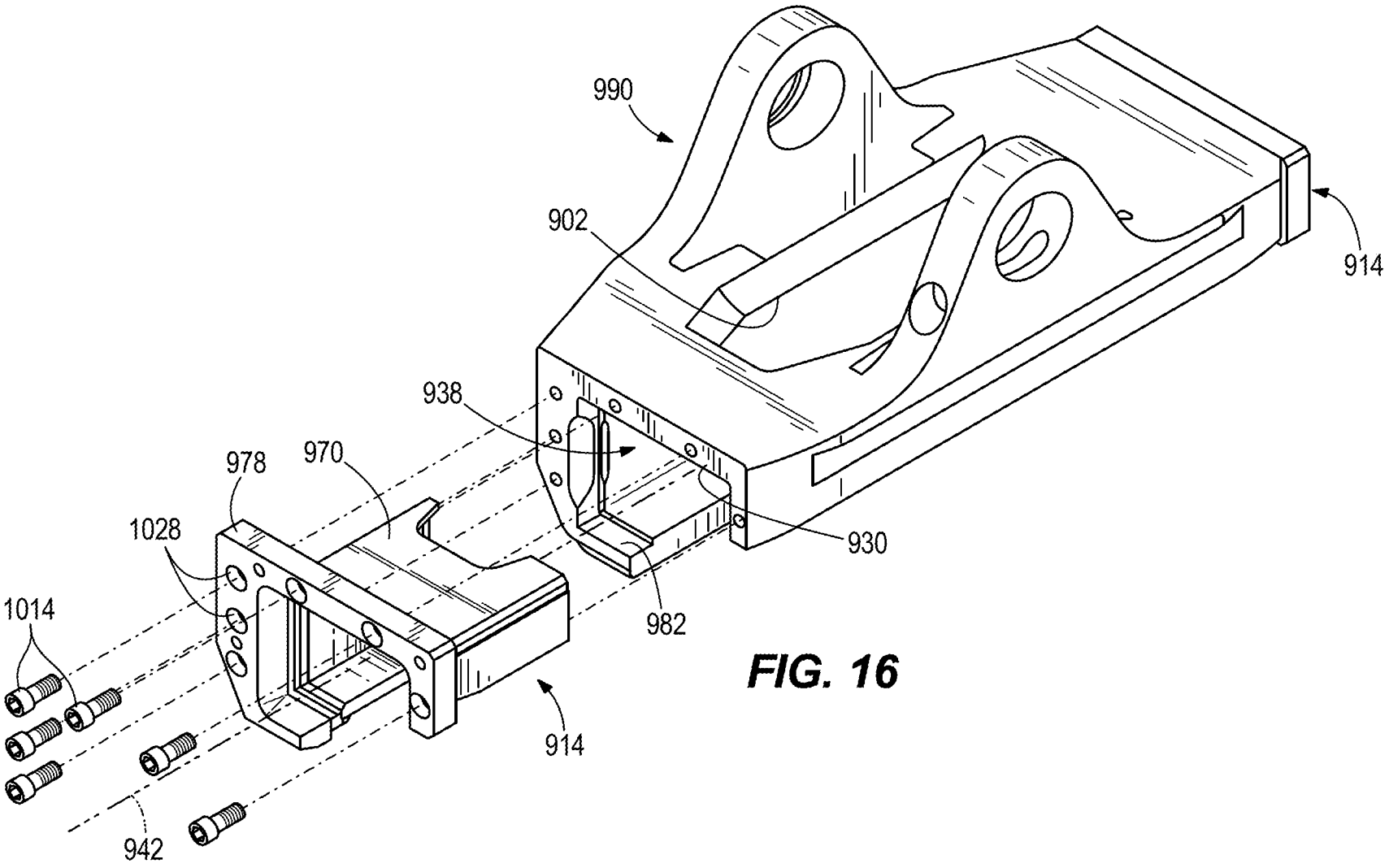
FIG. 16 is an exploded view of a guide shoe and an insert according to another embodiment.
Figure 17:
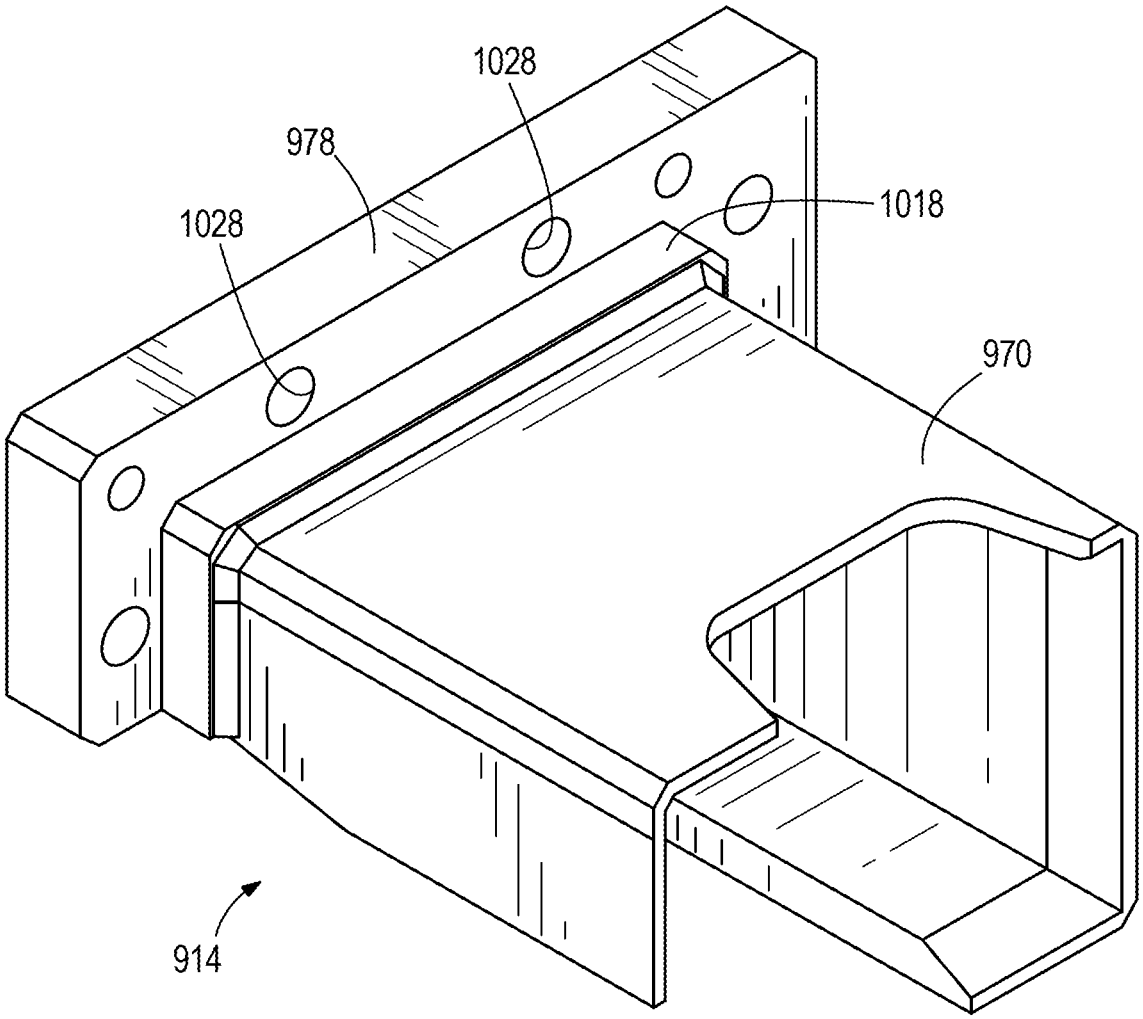
FIG. 17 is a reverse perspective view of the insert of FIG. 16.

FIGS. 16 and 17 illustrate a guide shoe 890 according to another embodiment. For the sake of brevity, only differences between the guide shoe 890 and the guide shoe 90 are described. Similar features are labeled with similar reference numbers, plus 800.

The guide shoe 890 includes an insert 914 including an insert body 970 and a flange 978. Unlike the guide shoe 90, the guide shoe 890 does not include a separate retainer. Rather, the insert 914 is directly coupled to the first end 930 of the shoe body 910. In particular, the flange 978 includes apertures 1028 through which first fasteners 1014 extend. In addition, the insert 914 includes a pilot or ridge 1018 formed between the insert body 970 and a surface of the flange 978 facing toward the shoe body 910. The ridge 1018 is positioned within a complementary shoulder 982 on the opening of the slot 938 proximate the first end 930 of the shoe body 910 to align the insert 914 relative to the slot 938.

Although some aspects of certain embodiments have been described in detail, variations and modifications exist within the scope and spirit of one or more independent aspects as described.

What is claimed is:

1. A guide shoe for a mining machine, the guide shoe comprising:

an elongated shoe body including a first end, a second end, and a slot extending between the first end and the second end along a slot axis, the shoe body further including a first wall extending along a first side of the slot and a second wall extending along a second side of the slot;

an insert coupled to the shoe body to inhibit rotation of the insert relative to the shoe body during operation of the mining machine, the insert extending along at least a portion of a perimeter of a cross-section of the slot, the insert positioned between the first wall and the slot axis and between the second wall and the slot axis, the insert including an end positioned adjacent the first end of the shoe body; and a fastener for securing the insert against movement relative to the shoe body in a direction parallel to the slot axis, the fastener including a longitudinal axis oriented in a direction parallel to the slot axis.

2. The guide shoe of claim 1, wherein the end of the insert includes a flange, and wherein the fastener extends through the flange of the insert and into the first end of the shoe body.

3. The guide shoe of claim 1, further comprising a retainer member secured to the shoe body by the fastener, the retainer member abutting the end of the insert to secure the insert against movement relative to the body in the direction parallel to the slot axis.

4. The guide shoe of claim 3, further comprising a cover coupled to the retainer member.

5. The guide shoe of claim 1, wherein the shoe body includes at least one longitudinal groove in communication with the slot and extending in a direction parallel to the slot axis, wherein the insert includes a longitudinal projection extending along a length of the insert, the longitudinal projection positioned within the longitudinal groove.

6. The guide shoe of claim 1, wherein the first wall is an upper wall, the shoe body further including an opening extending through the upper wall and being in communication with the slot.

7. The guide shoe of claim 1, wherein the first wall is an upper wall and the second wall is a base wall, the shoe body further including a forward wall projecting from the upper wall in a direction substantially parallel to the base wall, wherein the insert includes a first portion extending along a width of the upper wall, a second portion extending along a height of the base wall, and a third portion extending along a height of the forward wall.

8. The guide shoe of claim 1, wherein the first end of the shoe body includes a recess, wherein the insert includes at least one tab protruding from the end of the insert in a direction substantially perpendicular to the slot axis.

9. The guide shoe of claim 1, wherein the first wall is an upper wall and the second wall is a base wall, wherein the insert includes a first portion extending along a length of the upper wall in a direction transverse to the slot axis, a second portion extending along a length of the base wall in a direction transverse to the slot axis, and a hook portion projecting from the base wall in a direction substantially parallel to the upper wall.

10. A drive mechanism for a mining machine, the drive mechanism configured to engage and move the mining machine along a rack, the drive mechanism comprising:

a motor;

a gear driven by the motor and configured to engage the rack such that rotation of the gear moves the mining machine along the rack; and a guide shoe for maintaining engagement between the gear and the rack, the guide shoe including, an elongated shoe body including a first end, a second end, and a slot extending between the first end and the second end along a slot axis, the body further including a first wall extending along a first side of the slot and a second wall extending along a second side of the slot;

an insert coupled to the shoe body to inhibit rotation of the insert relative to the shoe body during operation of the mining machine, the insert extending along at least a portion of a perimeter of a cross-section of the slot, the insert positioned between the first wall and the slot axis and between the second wall and the slot axis, the insert including an end positioned adjacent the first end of the shoe body; and a fastener for securing the insert against movement relative to the body in a direction parallel to the slot axis, the fastener including a longitudinal axis extending in a direction parallel to the slot axis.

11. The drive mechanism of claim 10, further comprising a retainer member secured to the shoe body by the fastener, the retainer member abutting the end of the insert to secure the insert against movement relative to the body in the direction parallel to the slot axis.

12. The drive mechanism of claim 10, wherein the shoe body includes at least one longitudinal groove in communication with the slot and extending in a direction parallel to the slot axis, wherein the insert includes a longitudinal projection extending along a length of the insert, the longitudinal projection positioned within the longitudinal groove.

13. The drive mechanism of claim 10, wherein the first wall is an upper wall, the shoe body further including an opening extending through the upper wall and being in communication with the slot, the gear extending through the opening to engage the rack.

14. The drive mechanism of claim 10, wherein the first wall is an upper wall and the second wall is a base wall, the shoe body further including a lateral wall spaced apart from the base wall and protruding from the upper wall in a direction substantially parallel to the base wall, wherein the insert includes a first portion extending along a length of the upper wall in a direction transverse to the slot axis, a second portion extending along a length of the base wall in a direction transverse to the slot axis, and a third portion extending along a length of the forward wall in a direction transverse to the slot axis.

15. The drive mechanism of claim 10, wherein the first wall is an upper wall and the second wall is a base wall, wherein the insert includes a first portion extending along a length of the upper wall in a direction transverse to the slot axis, a second portion extending along a length of the base wall in a direction transverse to the slot axis, and a hook portion spaced apart from the upper wall and extending from the base wall in a direction substantially parallel to the upper wall.

16. A guide shoe for a mining machine, the guide shoe comprising:

an elongated shoe body including a first end, a second end, a first wall, and a second wall;

a slot extending between the first end and the second end along a slot axis, the slot extending along the first wall and the second wall;

an insert coupled to the shoe body to inhibit rotation of the insert relative to the shoe body during operation of the mining machine, the insert positioned between the shoe body and the slot axis and extending along at least a portion of a perimeter of a cross-section of the slot, the insert including an end positioned adjacent the first end of the shoe body; and a retainer removably secured to the shoe body, the retainer abutting the end of the insert to secure the insert against movement relative to the shoe body in a direction parallel to the slot axis, wherein the insert is insertable into the slot along the slot axis to couple the insert to the shoe body.

17. The guide shoe of claim 16, further comprising a plurality of fasteners extending through the retainer and into the first end of the shoe body to secure the retainer to the shoe body.

18. The guide shoe of claim 16, wherein the shoe body includes at least one longitudinal groove in communication with the slot and extending in a direction parallel to the slot axis, wherein the insert includes a longitudinal projection extending along a length of the insert, the longitudinal projection positioned within the longitudinal groove.

19. The guide shoe of claim 16, wherein the first wall is an upper wall and the second wall is a base wall, the base wall oriented perpendicular to the upper wall, wherein the shoe body further includes a forward wall projecting from the upper wall in a direction substantially parallel to the base wall, wherein the insert includes a first portion extending along a width of the upper wall, a second portion extending along a height of the base wall, and a third portion extending along a height of the forward wall.

20. The guide shoe of claim 16, wherein the first end of the shoe body includes a recess, wherein the insert includes at least one tab protruding from the end of the insert in a direction substantially perpendicular to the slot axis.

21. The guide shoe of claim 16, wherein the first wall is an upper wall and the second wall is a base wall, wherein the insert includes a first portion extending along a length of the upper wall in a direction transverse to the slot axis, a second portion extending along a length of the base wall in a direction transverse to the slot axis, and a hook portion projecting from the base wall in a direction substantially parallel to the upper wall.

22. The guide shoe of claim 21, wherein the shoe body further includes a hook wall extending from a lower end of the base wall, and wherein the hook portion of the insert extends along a length of the hook wall in a direction transverse to the slot axis.

* * * * *